United States Patent [19]

Kaye

[11] Patent Number: 4,556,009

[45] Date of Patent: Dec. 3, 1985

[54] BOAT WITH STABILIZING FLAPS

[76] Inventor: Alex R. Kaye, 5 Patricia Pl., Menlo Park, Calif. 94025

[21] Appl. No.: 677,331

[22] Filed: Dec. 3, 1984

Related U.S. Application Data

[63] Continuation of Ser. No. 462,811, Feb. 1, 1983, abandoned.

[51] Int. Cl.[4] ..... B63B 7/00

[52] U.S. Cl. ..... 114/354; 114/285

[58] Field of Search ..... 114/145 R, 145 A, 284–287, 114/352–354; 16/225; 224/257, 260, 264; 248/640–643

[56] References Cited

U.S. PATENT DOCUMENTS

| | | | |
|---|---|---|---|
| 1,911,192 | 5/1933 | Harvey | 114/285 |
| 2,402,379 | 6/1946 | Ganahl | 114/145 |
| 2,651,441 | 9/1953 | Rav et al. | 224/264 |
| 2,816,521 | 12/1957 | Alexander | 114/145 |
| 3,106,375 | 10/1963 | Donaldson | 248/643 |
| 3,121,887 | 2/1964 | Baretta | 114/354 |
| 3,482,368 | 12/1969 | Stansbury | 16/225 |
| 3,530,816 | 9/1970 | Mitchell | 114/285 |
| 3,678,874 | 7/1972 | Flink | 114/285 |

FOREIGN PATENT DOCUMENTS

| | | | |
|---|---|---|---|
| 613615 | 12/1948 | United Kingdom | 114/353 |

*Primary Examiner*—Jesûs D. Sotelo

*Attorney, Agent, or Firm*—Townsend and Townsend

[57] ABSTRACT

A boat having a pair of bottom panels provided with respective flaps to cause the stern of the boat to ride relatively high in the water when the boat is driven forwardly in the water by an outboard motor. In one embodiment, the flaps pivot downwardly and provide drag for the stern in response to forward movement of the boat. In two other embodiments, the flaps provide planing surfaces near the stern. The boat can be collapsible in which case the bottom panels mate with resilient side panels to form, when collapsed, a flat sandwich configuration which, by the use of improved straps, can be carried on the top of a vehicle or can be hand-carried. An improved bracket for the stern of the boat is used to permit positive attachment of an outboard motor to the boat.

7 Claims, 17 Drawing Figures

FIG. 3
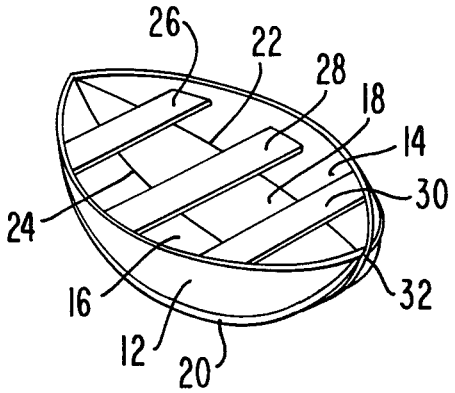
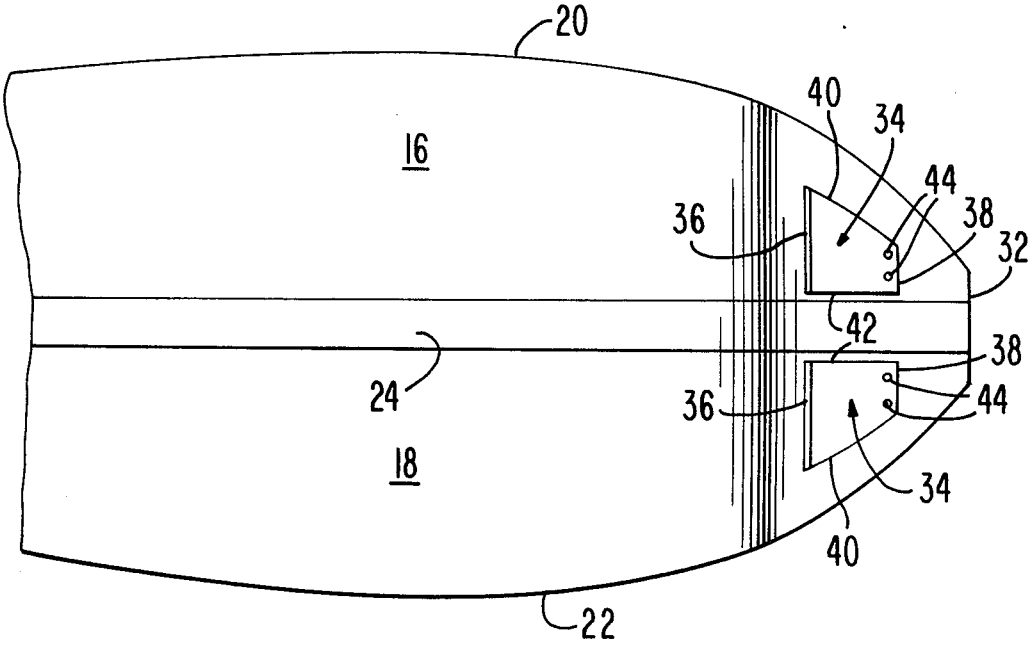
FIG. 4

BOAT WITH STABILIZING FLAPS

This is a continuation of application Ser. No. 462,811, filed Feb. 1, 1983, now abandoned.

This invention relates to improvements in the stabilizing of small boats having outboard motors and, more particularly, to a boat having flaps for keeping the stern of the boat from riding too low in the water as the boat moves in a forward direction.

BACKGROUND OF THE INVENTION

When an outboard motor is placed on a small boat and the boat is propelled forwardly under the influence of the motor, the stern of the boat has a tendency to sink lower into the water so that the bow rises accordingly. This condition is generally undesirable because the boat pitches as the bow continues to try to descend after it has been elevated. The ride in the boat becomes uncomfortable and stability is reduced.

This problem is especially evident with the use of an outboard motor on a collapsible boat of the type described in U.S. Pat. No. 3,482,368. This type of boat has a number of hingedly interconnected panels which move from side-by-side, collapsed positions to expanded positions in which the bottom of the boat is formed by a first pair of panels and the sides are formed by a second pair of sides. Such a boat is lightweight in construction and is easily expanded into its operational condition by one person. Attaching an outboard motor to such a boat gives good results except that a motor weighing in excess of about 30 pounds, such as a motor of 4.0 hp rating or above, typically is too large for use with the boat because of the problem mentioned above, especially if only one person is seated in the rear of the boat.

Because of such problem, a need exists for structure to be added to the boat to substantially eliminate the problem and thereby allow the boat to be used at desired speeds safely and comfortably. Prior art includes Canadian Pat. No. 940389.

SUMMARY OF THE INVENTION

The present invention satisfies the aforesaid need by providing a pair of flaps for the bottom panels of a boat. The panels can be of any one of several different embodiments, the purpose of the flaps being to provide either a drag force on the boat or to provide planing surfaces therefor. Thus, the flaps stabilize the boat so that stern of the boat has substantially no tendency to sink lower in the water as the boat is moved forwardly under the influence of an outboard motor. In this way, the boat is kept substantially level, is easier to handle, and can operate at greater speeds with minimum discomfort to an occupant of the boat.

The primary object of the present invention is to provide a boat having flap means thereon to cause the boat to remain substantially level in the water and to prevent the lowering of the stern of the boat during forward movement thereof through the water to eliminate stability problems and to achieve greater speed for the boat without discomfort to an occupant of the boat.

Another object of the present invention is to provide a collapsible boat having a pair of bottom panels with each panel having a flap thereon in position to provide either drag for the boat near the stern or to provide a planing surface to keep the stern riding relatively high in the water during forward movement of the boat to avoid the problems caused by lowering of the stern, such as when an outboard motor is used with the boat.

Other objects of this invention will become apparent as the following specification progresses, reference being had to the accompanying drawings for an illustration of the invention.

In the Drawings:

FIG. 3 is a perspective view of the boat of FIGS. 1 and 2;

FIG. 4 is a fragmentary, bottom plan view of the boat in its expanded condition showing a pair of the flaps of FIG. 1 near the stern of the boat;

Figure 9:
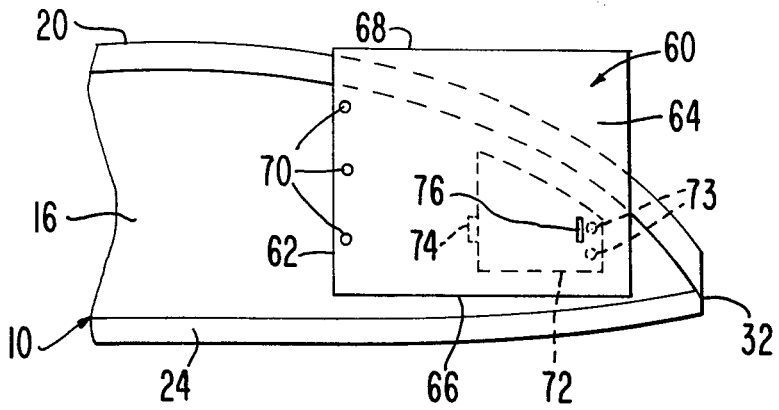
FIG. 9 is a fragmentary, side elevational view similar to FIG. 1 but showing a second embodiment of the flaps of the present invention.
Figure 10:
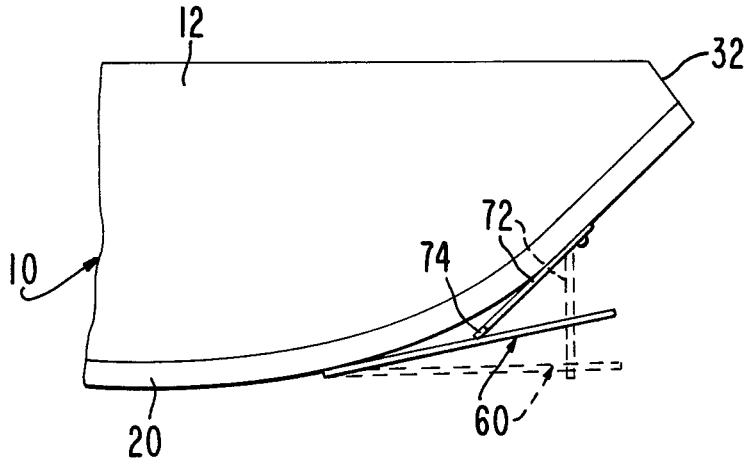
FIG. 10 is a fragmentary, side elevational view similar to FIG. 2, showing the flaps of FIG. 9 in retracted positions and in operative positions.
Figure 11:
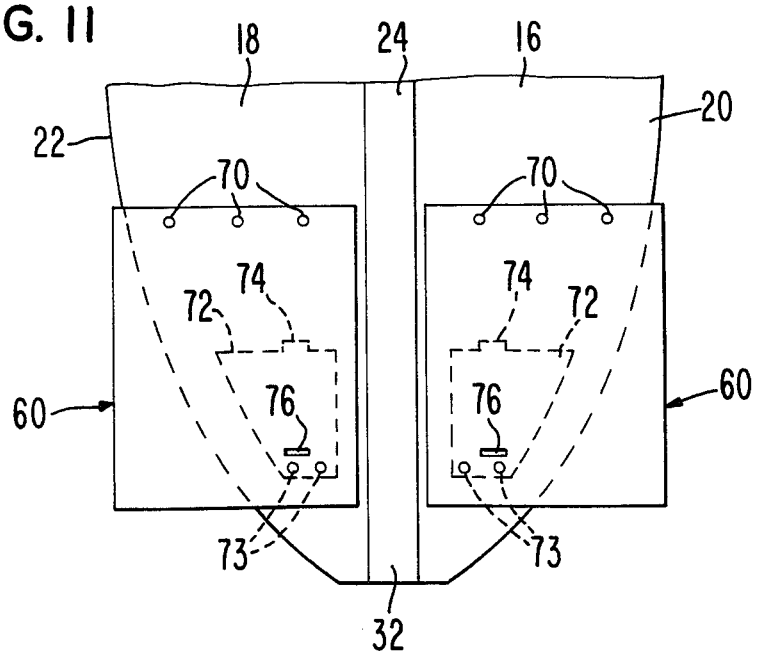
FIG. 11 is a view similar to FIG. 4 but showing the flaps of FIGS. 9 and 10.
Figure 13:
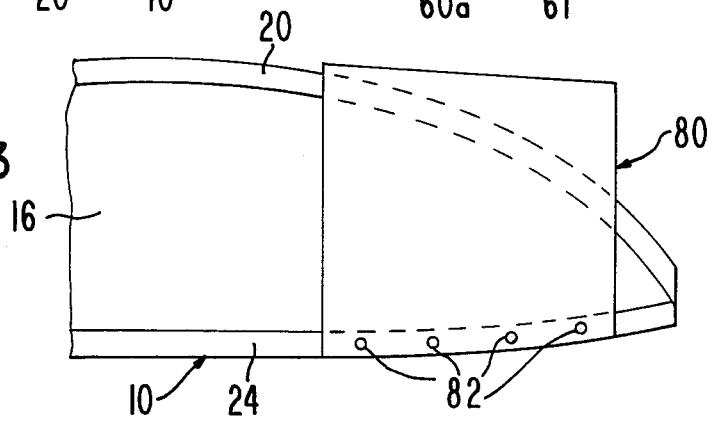
Figure 14:
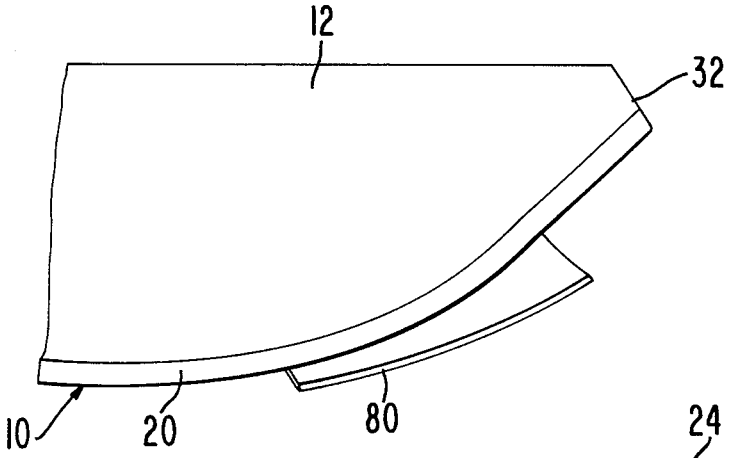
Figure 15:
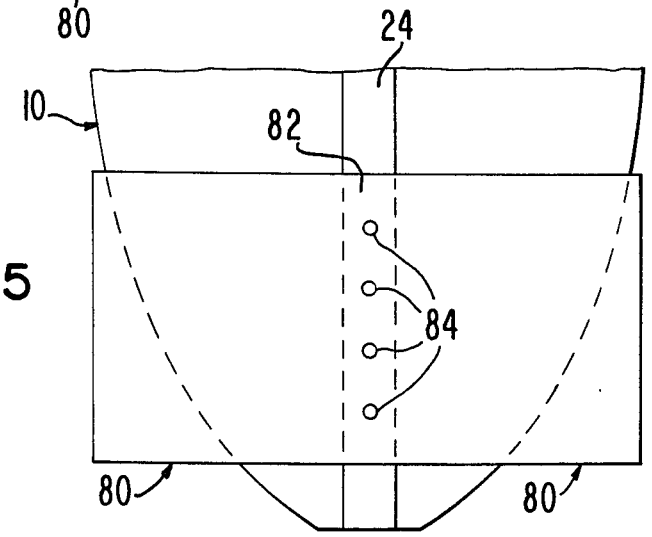
Figure 16:
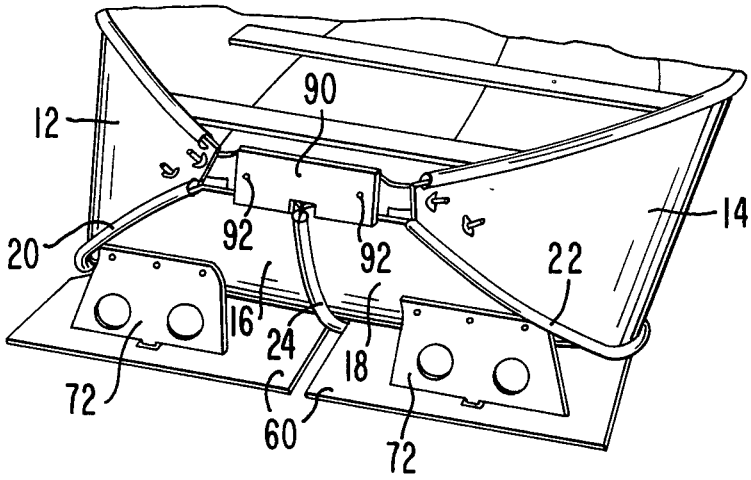
Figure 17:
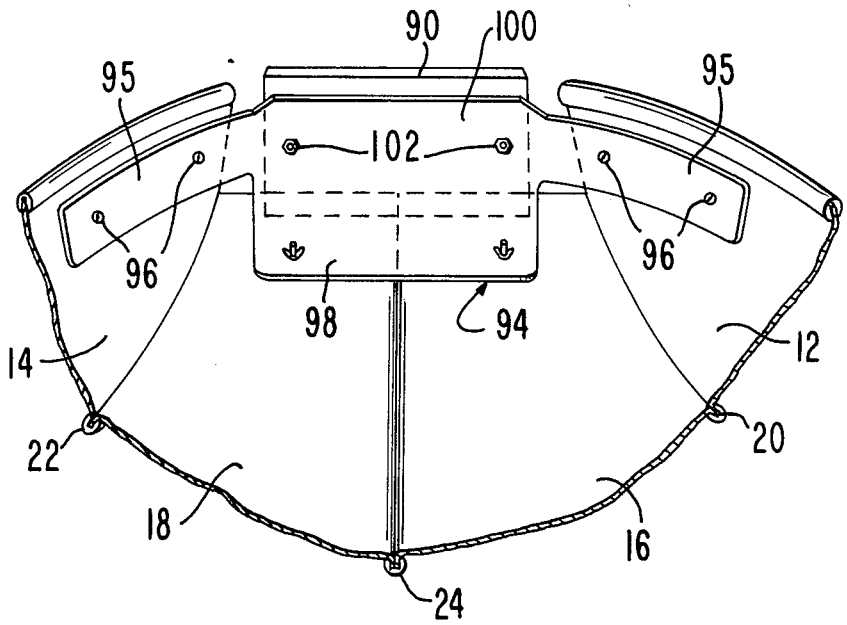

FIGS. 13, 14, and 15 are views similar to FIGS. 9, 10, and 11 but showing a third embodiment of the flaps of the present invention;

FIG. 16 is a fragmentary, perspective view of the rear end of the boat showing the flaps of FIGS. 9–11 mounted thereon and illustrating a rectangular plate secured to the upper ends of adjacent panels of the boat; and FIG. 17 is a perspective view of an improved bracket for attachment to the plate of FIG. 16 for attaching an outboard motor to the boat.

The present invention is adapted to be used with a boat at the stern thereof to keep the stern from dropping too far into the water as the boat moves forwardly, especially when driven by an outboard motor near the stern of the boat. For purposes of illustration, the present invention will be described with respect to a collapsible boat 10 of the type described in U.S. Pat. No. 3,482,368.

Figure 1:
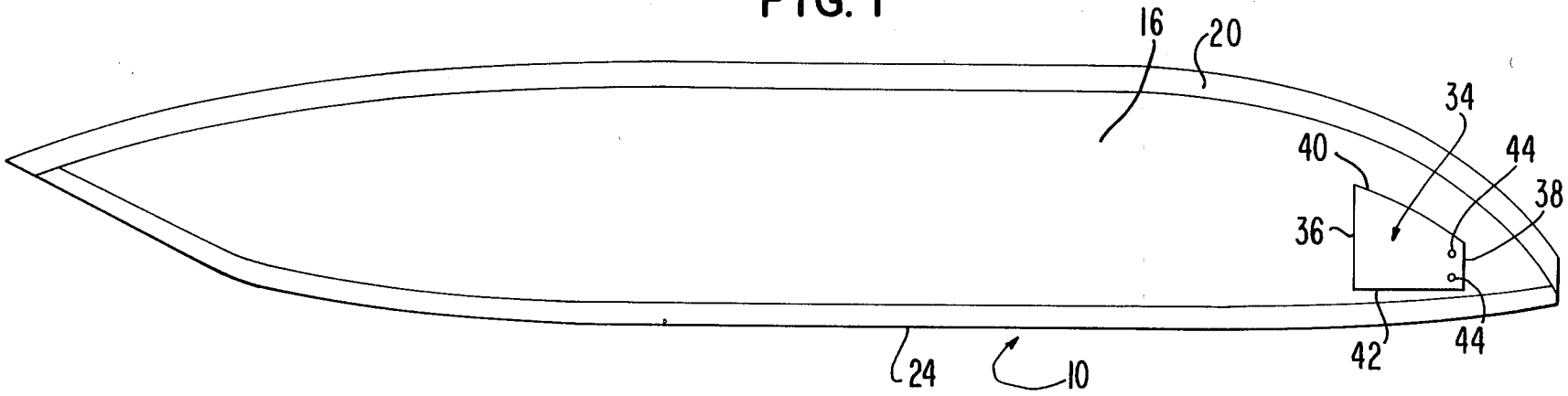
FIG. 1 is a side elevational view of a collapsible boat, showing one embodiment of the flap of the present invention on one panel of the boat.
Figure 2:
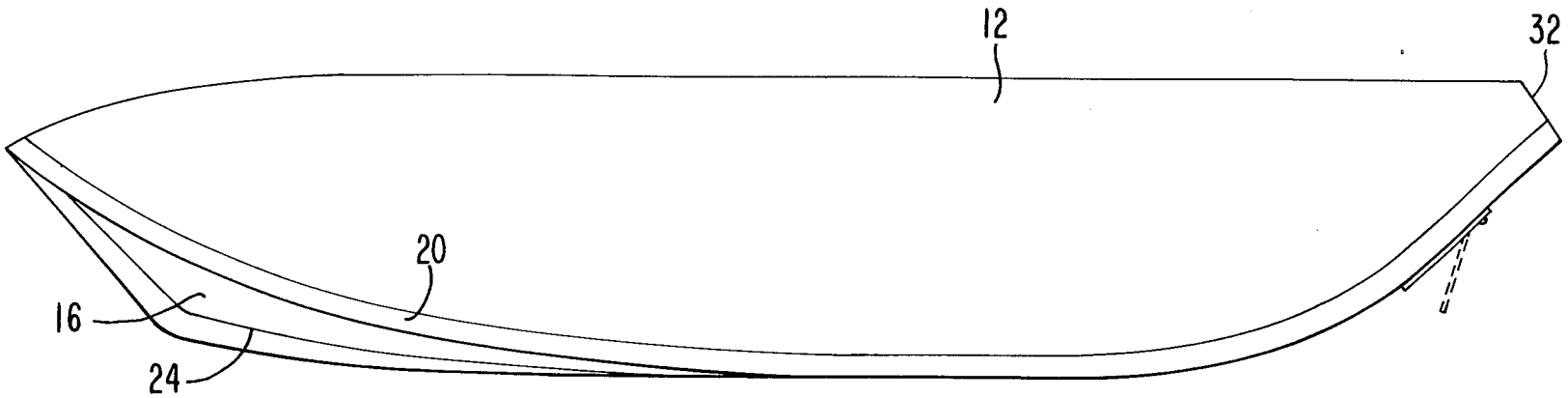
FIG. 2 is a side elevational view of the boat of FIG. 1 with the boat in an expanded condition, showing the flap in a retracted position and in an operative position.

Such a boat, in its expanded form is shown in FIG. 3 and includes a pair of side panels 12 and 14 and a pair of bottom panels 16 and 18. Panels 12 and 16 are hingedly coupled along a first hinge line 20; panels 14 and 18 are hingedly coupled along a second hinge line 22; and panels 16 and 18 are hingedly coupled along a third hinge line 24. The panels of boat 10 are formed from a resilient sheet material, such as polyethylene, having a thickness of about 0.25 inches. In the expanded condition of the boat, planks 26, 28 and 30 are inserted between panels 12 and 14 as shown in FIG. 3 to keep panels 12 and 14 bowed outwardly and separated from each other. Panels 12 and 14 have a tendency to return to their collapsed or inoperative positions due to their resilience; thus, they exert endwise forces on planks 26, 28 and 30, thereby holding the planks in place. By removing the planks, the boat will collapse and fold into a compact condition as shown in FIG. 1, only panel 16 being shown in FIG. 1, the other panels being aligned with panel 16 but on the opposite side thereof and not observable in FIG. 1. However, hinge lines 20 and 24 are seen in FIG. 1. In FIG. 2, the boat is shown in its expanded condition with panel 12 being observed along with panel 16 and hinge lines 20 and 24.

Boat 10 can be used with paddles or with an outboard motor. If a motor is used, the motor is attached to the stern 32 of the boat and the boat can then be driven in a forward direction by the motor.

The problem which arises with the use of a motor of a sufficient size, such as one weighing in excess of about 30 pounds, the stern of the boat commences to lower while the bow of the boat rises as the speed increases. This causes a loss in stability and makes the ride in the boat uncomfortable to the boat occupant. The present invention, therefore, provides a flap system for a boat, particularly boat 10, to eliminate this problem and to provide a means for keeping the stern relatively high in the water, i.e., keeping the boat substantially level in the water, especially when the boat has only a single occupant.

A first embodiment of the flap system of the present invention is shown in FIGS. 1, 2, and 4. This system includes a pair of flaps 34 which have front marginal edges 36 and rear marginal edges 38. Each flap 34 has an outer side edge 40 and an inner side edge 42. Each flap is secured near its rear edge 38 by fasteners 44 to the bottom surface of a respective bottom panel of the boat. Edge 42 of each flap is near hinge line 24 as shown in FIGS. 1 and 4, and edge 40 of each flap particularly extends longitudinally of the curvature of hinge line 20 as shown in FIG. 1.

Flaps 34 are formed from a suitable material, such as polypropylene. Thus, in its retracted position, each flap 34 will be generally contiguous to the bottom surface of the boat in the manner shown in FIG. 2. However, as the boat moves forwardly, the force of the water due to forward thrust of the boat tends to cause the flap to assume the dashed line position shown in FIG. 2. In this position of the flap, the boat experiences drag due to the flaps, and this condition will cause the stern of the boat to ride relatively high in the water. Thus, the movement of the flaps 34 from their retracted positions to their operative positions is in response to the movement of the boat through the water. When the boat's speed decreases to a negligible value, the flaps substantially return to the retracted positions shown in full lines in FIG. 2.

Figure 6:
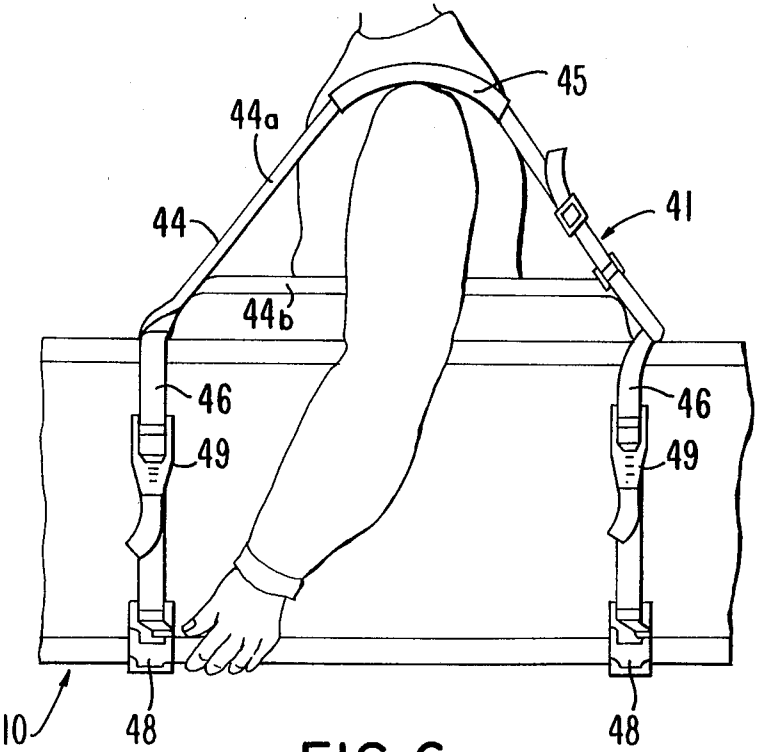
FIG. 6 is a fragmentary, side elevational view of the boat in its collapsed condition, showing the way in which the straps of FIG. 5 are used to hand-carry the boat.
Figure 5:
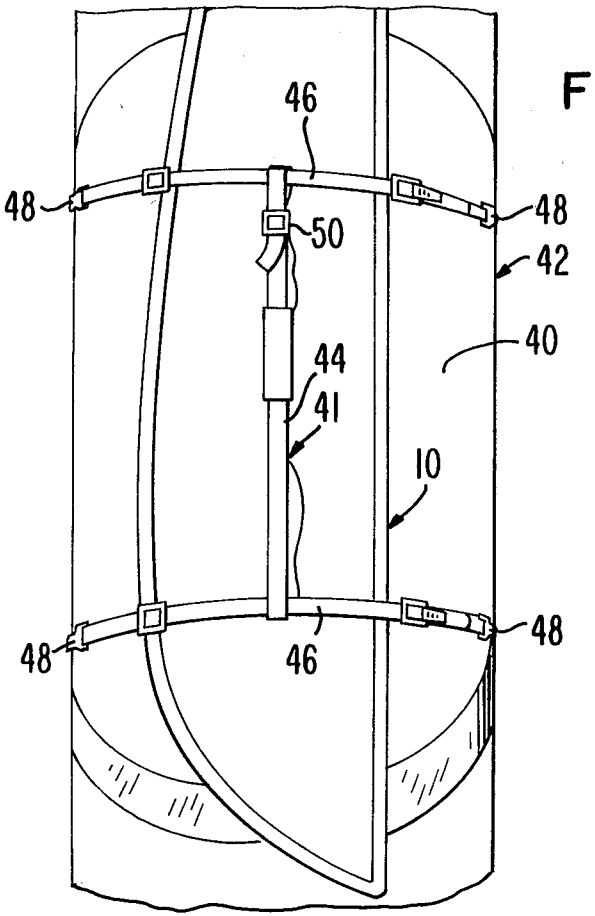
FIG. 5 is a fragmentary, plan view of a vehicle showing the boat of FIG. 1 strapped on the roof of the vehicle.
Figure 7:
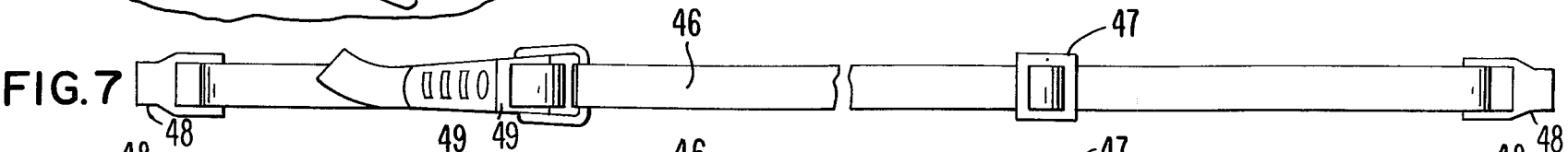
FIG. 7 is a top plan view of one of the strap port parts of the strap means of FIGS. 5 and 6.
Figure 8:
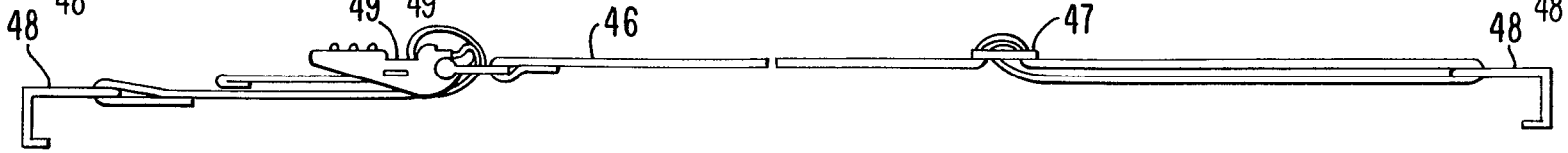
FIG. 8 is a side elevational view of the strap of FIG. 7.

Strap means 41 (FIGS. 5–8) is used to releasably carry the boat, when collapsed, from the top of a vehicle 42 and also for carrying the boat by hand as shown in FIG. 6. Strap means 41 includes a center strap 44 and a pair of end straps 46 which pass through loops at the ends of center strap 44. The ends of each strap 46 have hooks 48 as shown in FIGS. 7 and 8 for releasably attaching the straps to the rain gutters on the sides of the vehicle 42. Take-up buckles 49 of conventional construction are provided for each strap 46, respectively, so that the length of the strap can be adjusted for use in the manner shown in FIG. 5 and for the use in the manner shown in FIG. 6.

When used in the manner shown in FIG. 6, each strap 46 has its end hooks 48 coupled together so that the strap forms a loop which encircles the boat as shown in FIG. 6. Moreover, strap 44 has a take-up loop 50 which allows adjustment in the length of strap 44 for use in the manner shown in FIG. 5 and in the manner shown in FIG. 6. Typically, strap 44 is formed into two segments, **44*a* and 44*b*, as shown in FIG. 6. A sheath 45 is carried on segment 44*a* to provide a cushion effect to prevent discomfort to the person carrying the boat with strap means 41**.

A second embodiment of the flap system of the present invention is shown in FIGS. 9–11 and includes a pair of flaps 60 which are generally rectangular in shape as shown in FIGS. 9 and 11. Each flap 60 has a front edge margin 62, a rear end margin 64 and a pair of side edge margins 66 and 68 (FIG. 9). Each flap 60 is secured by fasteners 70 near the front marginal edge 62 thereof, fasteners being secured to bottom panel 16 and 18 (FIG. 3).

Typically flaps 60 are formed from a suitable, resilient material, such as polypropylene material of about 0.25 inches thick. In the retracted positions, flaps 60 normally assume the full line positions of FIG. 10 wherein they extend rearwardly and upwardly from the bottom panel 16 and 18. However, the flaps 60 can be moved into operative positions (the dashed line positions of FIG. 10) by moving, smaller flaps 72 from the full line positions of FIG. 10 to the dashed line positions, each flap 72 having a tab 74 on the lower end thereof which is frictionally received within a slot 76 in the corresponding flap 60. This attachment holds flap 60 in the dashed line position of FIG. 10 and causes flap 60 to form a planing surface for the boat when the boat is driven through the water by an outboard motor coupled to the stern 32 of the boat. The planing action of flaps 60 keeps the stern riding relatively high in the water and keeps the bow relatively low in the water, thus providing increased stability for the boat and allowing a single occupant of the boat to ride in a more comfortable fashion.

Flaps 60 are also shown in FIG. 16 in their operative positions in which the flaps 60 are held in place by smaller flaps 72. Each smaller flap 72 has a pair of holes therethrough to allow water to pass through the flap without exerting a substantial rearward force thereon. The smaller flaps are secured by fasteners 73 to bottom panels 16 and 18.

Figure 12:
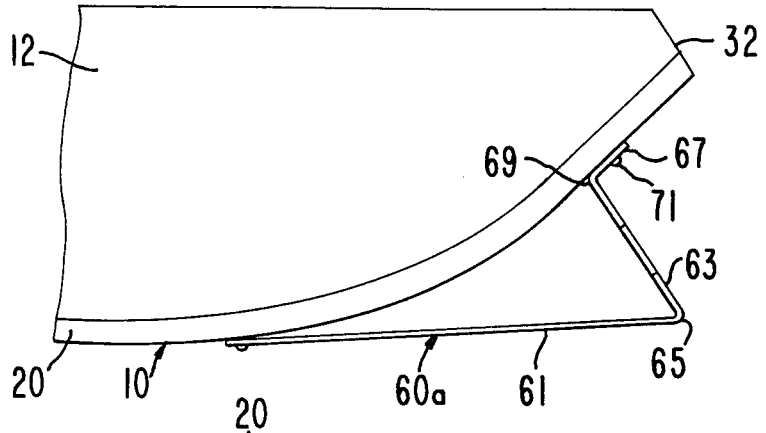
FIG. 12 is a view similar to FIG. 10 but showing a modification of the flaps thereof.

FIG. 12 shows a modification of flap 60. In this figure, flap **60*a* is of a one-piece construction and has a lower, main segment 61 for planing purposes. A second, upper segment 63 is hinged to and integral with segment 61 at a rear location 65. A third segment 67 is hinged to and integral with segment 63 at location 69. A pin 71 is removably secured to the adjacent bottom panel of the boat to releasably secure segment 67 to the boat with main segment 61 in its operative, planing position shown in FIG. 12. When pin 71 is removed, segments 63 and 67 straighten out and become substantially coextensive with segment 61. As a result of water force on the flap 60*a***, the flap will be forced upwardly and against the adjacent bottom panel of the boat and no planing action will occur.

A third embodiment of the flap system of the present invention is shown in FIGS. 13–15 and includes a pair of generally rectangular flaps 80 which are integral with each other and form a center strip 82 as shown in FIG. 15. Strip 82 is secured by fasteners 84 or other means to boat 10 on the hinge line 24 thereof, there being no other connection of flaps 80 to the boat as in the case of flap 34 and 60 described above. Thus, the flap system of FIGS. 13–15 is a one-piece construction and is comprised of a resilient material, such as polypropylene or the like. A typical thickness of flaps 80 is 0.25 inches.

The resilience of flaps 80 causes them to be substantially contiguous with the other surface of panel 16 as shown in FIG. 13 when boat 10 is collapsed. However, when the boat is expanded into its operative position as shown in FIG. 3, the flaps 80 extend laterally and outwardly of hinge line 24 in spaced relationship to bottom panels 16 and 18 as shown in FIG. 14 so that they typically assume positions very nearly the same as those of flaps 60 (FIGS. 10 and 11) except that flaps 80 might possibly project slightly downwardly from bottom panels 16 and 18 due to the resilience of flaps 80. In any case, in their operative positions, flaps 80 provide a planing effect for boat 10 which causes the stern of the boat to ride relatively high in the water when the boat is propelled forwardly, such as with an outboard motor attached to stern 32 of the boat.

To assist in securing an outboard motor to the boat, boat 10 is provided with a rigid plate 90 (FIGS. 16 and 17), plate 90 being secured by fasteners 92 to rear ends of bottom walls 16 and 18. For purposes of illustration, flaps 60 are shown in FIG. 16, the flaps being in their operative positions and held by second flaps 72.

To rigidify the connection between plate 90 and boat 10, a rigid bracket 94, preferably of metal, is carried by fasteners 96 on boat 10, bracket 94 having a lower flange 98 and an upper flange 100. Lower flange 98 extends along the inner surface of bottom panels 16 and 18 of the boat, and upper flange 100 extends along the inner surface of plate 90 and is secured to plate 90 by fasteners 102. Thus, an outboard motor can be rigidly secured to plate 90 and flange 100 and thereby be more safely connected to the boat. The connection of the side flanges 95 of bracket 94 assures that a downward force can be exerted on plate 90 while keeping the plate in a fixed position with respect to the boat.

What is claimed is:

1. A boat comprising: a collapsible hull having a bow and a stern and having a pair of hingedly interconnected bottom panels extending between the bow and stern, there being a pair of side panels hingedly connected to respective bottom panels and extending longitudinally thereof, said hull being movable from a collapsed condition in which the panels are in substantial face-to-face relationship to an expanded condition in which adjacent panels extend outwardly from each other; a pair of first flaps secured to the outer surfaces of respective bottom panels on opposite sides of the hinge line between the bottom panels for causing the stern to ride relatively high in the water as the boat is driven in a forward direction whereby the boat remains substantially level with respect to the water surface during such forward movement, each of said first flaps being movable from a retracted position extending along the adjacent surface of a respective bottom panel to an operative position extending transversely of the respective bottom panel, each flap being in the retracted position when the hull is in said collapsed condition; and a second flap for each first flap, respectively, each second flap being coupled to the outer surface of a respective bottom panel and movable into an operative location in which the second flap engages the respective first flap and releasably holds it in its operative position, each second flap being movable into a retracted location in which the second flap extends along the adjacent surface of the respective bottom panel substantially contiguous with the respective first flap, whereby the hull and the first and second flaps form a compact unit when the hull is collapsed.

2. A boat as set forth in claim 1, wherein the first flaps extend rearwardly of the bottom panels of the boat to form planing surfaces therefor when the flaps are in said operative positions thereof.

3. A boat as set forth in claim 1, wherein each second flap has at least one hole therethrough to allow water to pass through the flap as the boat moves forwardly when the second flap is in its operative location.

4. A boat as set forth in claim 1, wherein each first flap has a slot therethrough, each second flap having a tab extending into the slot of the respective first flap for releasably coupling respective first and second flaps together.

5. A boat as set forth in claim 1, wherein each second flap is hingedly coupled to the respective bottom panel of the boat.

6. A boat as set forth in claim 1, wherein the said hull has a pair of side panels hingedly coupled to the outer marginal edges of respective bottom panels, whereby said hull can be collapsed and expanded, and means coupled with the side panels for holding the hull in its expanded condition.

7. A boat as set forth in claim 1, wherein each first flap is formed of resilient material and secured at its front marginal edge by fasteners to the respective bottom panel.

* * * * *